United States Patent [19]

Booth

[11] 3,959,801

[45] May 25, 1976

[54] DYNAMIC OPTICAL FONT AVAILABILITY SYSTEM

[75] Inventor: Thomas A. Booth, Flanders, N.J.

[73] Assignee: Addressograph Multigraph Corporation, Cleveland, Ohio

[22] Filed: Apr. 10, 1975

[21] Appl. No.: 566,786

[52] U.S. Cl. ..... 354/7; 354/13; 354/14

[51] Int. Cl.[2] ..... B41B 17/06

[58] Field of Search ..... 354/5, 7, 11, 12, 13, 354/14, 15

[56] References Cited

UNITED STATES PATENTS

| | | | |
|---|---|---|---|
| 2,989,904 | 6/1961 | Braggs et al. | 354/14 |
| 3,099,945 | 8/1963 | O'Brien | 354/13 |

*Primary Examiner*—Joseph W. Hartary
*Attorney, Agent, or Firm*—Ray S. Pyle

[57] ABSTRACT

A photographic compositor having a letter pattern carrying section comprising a plurality of letter pattern carrying discs which are rotatably mounted on a common rotatable shaft at intervals. A dynamic optical system provides a collimated light beam source at a fixed location. A carriage with a sub-optical system decollimates and focuses the beam, transports the beam in an offset path to letter pattern of a disc, and recollimates the beam. The recollimated beam is then projected to a focusing lens and out to a photocomposer apparatus. The collimating system enables the carriage to be mobile and therefore the optical system is disposed to cooperate with one side of a selected disc wherein a beam for illuminating letter patterns carried in a track on a disc is caused to reside between a pair of adjacent letter carrying discs by causing the carriage of the optical system to move into an interspersing position with a selected disc wherein the beam may be passed through a letter pattern and out through the space between a pair of discs of the following stage in the offset path. The optical system and the letter pattern carrying section are mounted for movement of the carriage with respect to the letter pattern carrying section and the relative movement is in a path perpendicular to the axis of the rotatable shaft when the carriage is withdrawn. The perpendicular withdrawal movement of the carriage is carried out to a first limit which separates the carriage from the largest disc carried by the shaft upon which the disc members are mounted. A second limit of the carriage is in the opposite direction but perpendicular to the shaft direction and is moved to a preselected positional relationship to place the optical system in conjunction with a selected disc font track. The carriage is shiftable in the direction of the shaft axis while in said first limit position, whereby the carriage is caused to separate from a particular disc and shift to select another disc and back into a selection position with one track of the disc, without disturbing the optical system which enables the carriage to move by reason of the collimated portions of the optical system optically interconnecting the carriage into the system.

3 Claims, 5 Drawing Figures

DYNAMIC OPTICAL FONT AVAILABILITY SYSTEM

BACKGROUND OF THE INVENTION

This invention relates generally to improvements in photographic compositors and it relates particularly to an improved character storage device and optical retrieval and projection system.

Photographic composition is a relatively new art, and the art has concentrated most heavily upon reliability and composition technique. These areas have been well developed and effort is now progressing on speed. News and communication requires ever increasing repetity of typesetting.

The prior art does contain issued patents which have made an effort to increase speed and/or availability of font face designs by providing a plurality of rotating disc font source devices in one machine. An example of multiple disc source is Moyroud U.S. Pat. No. 3,602,116. In this patent a pair of interchangeable discs are removably mounted for rotation on a common shaft, and a lens turret is used for changing size. There are other patents by this inventor on the multiple projection concept.

A later development by a Japanese inventor, Nishikawa, set forth in U.S. Pat. No. 3,791,271 deals with the problem of languages which have a far greater number of characters than the English and European languages. Nishikawa uses a plurality of axially spaced coaxial discs with parallel flash beams directed parallel to the face of each disc, transmitted through characters, and then deflected parallel to and along the opposite face of the disc for selection of an individual character by manipulation of the output.

This latter development requires a considerable number of continuously operating lenses and reflecting systems with selection being accomplished by selection of a beam out of many beams coming from the group of discs.

Accordingly, the prior art to this time has suggested multiple disc font sources for two distinctively different purposes, but has not produced an ultimate font bank from which a large group of distinct character font faces can be stored and selectively projected for particular composition without the necessity of changing discs on a single or multiple spindle machine.

SUMMARY OF THE INVENTION

This invention has for its principal object an improved access system for making available particular font on a particular font track of one font storage disc in a bank of such discs.

In particular, this invention has for its object the provision of an optical system that will permit a moving carriage to act as a pickup head by intercepting a light beam, offsetting that beam in a focused condition to pick up a selected track from a superposed stack of disc members without changing the system focus.

DESCRIPTION OF THE PREFERRED EMBODIMENT

This invention is directed to a photocomposition machine in general, but the specific improvement is in the means for providing an increased quantity of font faces rapidly accessible. Thus, a photocomposition machine, whether it employs a collimated line escapement plan, an optical lever plan, a moving receiving surface carrier or some other plan, may receive photographic impressions from the novel portion of the disclosure herein.

Figure 5:
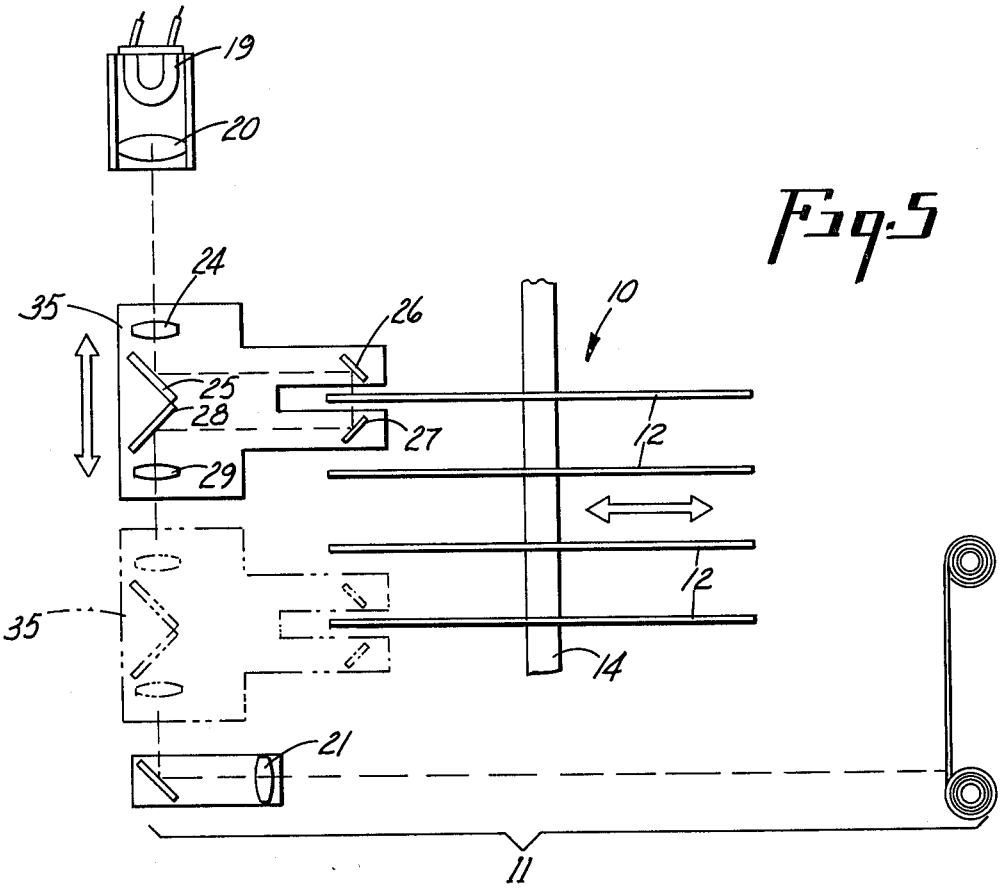
FIG. 5 is a schematic illustration of the optical system in conjunction with a series of rotating font discs, illustrating the function of the collimating concept.

In the drawing, referring particularly to FIG. 5, a letter pattern carry section 10 is shown providing a photographic font output to a photocomposer 11. The composer 11 is illustrated as using collimating lenses such as taught in U.S. Pat. No. 2,670,665.

Figure 1:
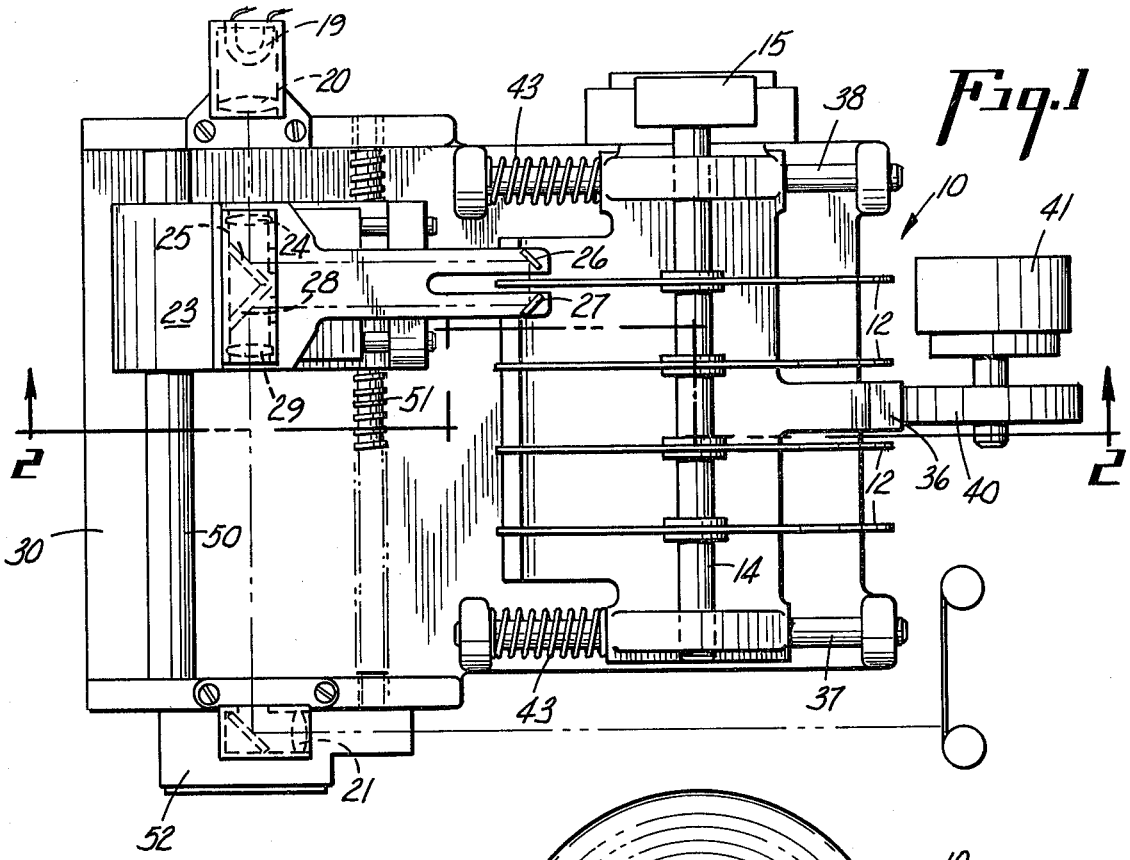
FIG. 1 is a top plan view of a font storage and optical retrieval system for a photocomposition machine.

The section 10 carries a plurality of indicia storage disc members 12 which are rotatably mounted on a common rotatable shaft 14 in superposed relationship substantially at regular intervals. A motor 15 is illustrated in FIG. 1 as the driving means for rotating the shaft 14 and the disc members about a common axis of the shaft.

Each disc member has at least one data set in a circular track path. Such disc members normally carry several data paths and one example of a suitable disc member is illustrated in U.S. Pat. No. 3,733,977. The markings in FIG. 2 on disc 12 suggest four data font tracks as one example.

An optical system 17, which may also be referred to as a projection system, is mounted on a support frame base 3. (See FIG. 1)

In the illustration, the means for accessing the data from a disc and bringing it out to the photocomposer 11 is literally an optical system, but may be thought more generically as a projection system because any means for extracting the shape and form of a character from a transparency and bringing it to the photocomposer is literally a means for projecting, or a projecting system.

The optical system 17 is a uniquely flexible projecting system which allows a xeon light source 19 and its power source (not shown) to remain at a fixed location, but have a moving carriage to access the discs 12. The principle employed is to produce a collimated beam between a collimating lens 20 and a decollimating lens 21, and to pick up the beam by a mobile stanchion 23 at any point to which the stanchion is shifted along the beam. The stanchion 23 is bifurcated and carries a decollimating lens 24 and a mirror 25 to turn the light beam from the lens 20 in a direction perpendicular to the face of a disc 12 interspersed between the arm ends of the bifurcated stanchion 23. The beam is then turned perpendicular to the disc face by a mirror 26.

Light passing through a disc 12 is picked up by a mirror 27 and turned ay a substantially right angle back to the base of the stanchion where a mirror 28 is mounted and projects the light path to a collimating lens 29. Lens 29 projects the beam to focusing lens 21 and the image is obtained for use by the photocomposer 11.

This described bifurcated stanchion with its arms and mirrors may be referred to as an offset side loop of the optical system because of its path configuration which can accept the disc members but provide the light source and focusing devices outside of the area of the disc members.

The collimated beam concept is known in photocomposers. See Caldwell U.S. Pat. No. 2,670,665. This invention provides a new use for such optical concept in the provision of keeping a focused mobile access carriage coupled to a stationary photocomposer machine in order to provide greatly expanded font storage capability.

In modern photocomposer procedures, the escapement action of the photosensitive paper within the composer 11 is related to the width value assigned to a particular character. In the English language, for example, the *m* and *w* letters are much wider than the letter *i*. Hence, if each letter is given uniform space, the resulting printed word is unpleasant to view and not harmonious. Hence, the escapement is normally less for the more narrow letters than the wider letters. The amount of escapement is established by the artist who designs the font and differs with different styles of font faces. It is not feasible to establish a given amount of escapement for a particular letter of an alphabet and expect every font style to appear harmonious. Therefore, the practice has been adapted to assign width codes on the disc 12 for each character that is to be projected. That width code is read by an optical system in the same manner as timing marks are read, and the information gleaned is supplied to a computer program which is used as a controller for the photocomposer 11. Also, it is normal that the width code track for a particular disc 12 will be the same for the group of fonts on that particular disc. Therefore, the system which gleans the width code information is normally focused upon the same area of the disc regardless of which one of the multiple fonts of that disc is selected.

In the illustrated embodiment of the invention, this multiple selection of fonts and unitary selection of width code is solved by means of a unique system which causes the width head to follow the movement of the carriage when the discs are indexed laterally but allows the projection system for the fonts to remain stationary in the lateral direction and hence relatively movable with respect to the plural disc track, that is, to be interspersed with the disc stack only to a fixed limit and allow the bifurcated stanchion 23 to move on to further limits in order to read any selected font track.

Figure 2:
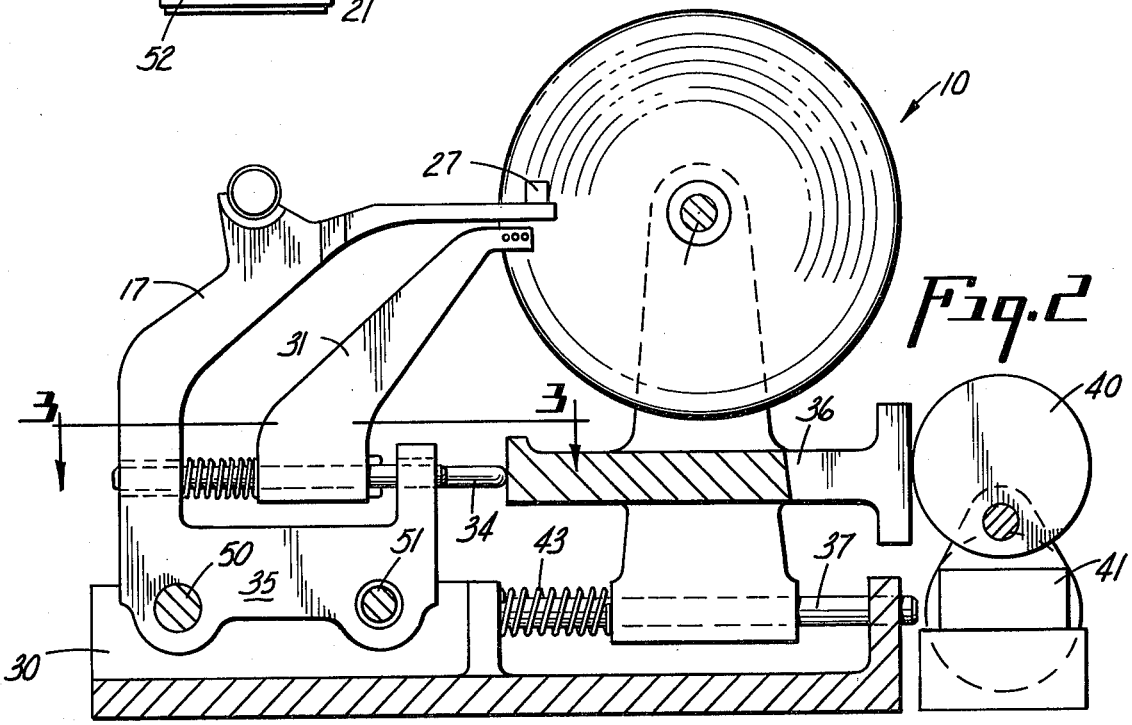
FIG. 2 is a section view taken along the line 2—2 of FIG. 1.
Figure 3:
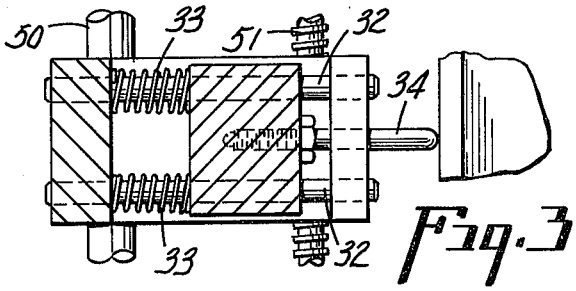
FIG. 3 is a section view of an optical system mounting portion of the system taken along line 3—3 of FIG. 2.
Figure 4:
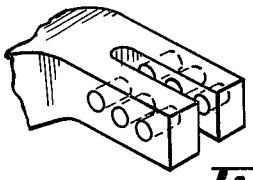
FIG. 4 is a detail of a timing track read head.

This may be explained by observing the FIGS. 2 and 3 in particular. A stanchion 31 may be referred to as a fixed track reader because it is intended to read the same width code track regardless of the indexed position of the frame and the pluraity of discs 12. The stanchion 31 is mounted upon ways 32 as shown in FIG. 3, and urged toward the frame which carries the discs by means of springs 33. A cam rod 34 is carried by a carriage base 35 and is directed toward a bumper section of a disc support carriage 36. Therefore, the movement of the stanchion 31 is precisely the same as the movement laterally of the carriage 36. The result is that the reading devices carried by the end of the stanchion 31, (See FIG. 4) extract imforation from the disc in essentially the same manner as that described with respect to the stanchion 23, although a continuous light source and photocells are preferably employed rather than the optical focusing system.

The support carriage 36 is mounted in such a way that it provides a means for moving the disc 12 and the projection system 17 relative to one another in a series of defined paths which select a data set track path and project the data thereon, said series of paths comprising lateral relative movements which shift the disc and system relative to another such that the mirrors 26 and 27 embrace one of the selected font paths. Such lateral movement is provided by mounting carriage 36 on way rods 37 and 38 in order to cause the shaft 14 to move in a path which is perpendicular to its longitudinal axis, in a manner suggested by the arrows in the FIG. 5.

A cam 40 driven by a stepper motor 41 is employed to drive the carriage 36 toward the carriage base 35 and springs 43 urge the frame in the opposite direction. Hence, by moving the cam 40 through a definite nunber of driven steps by the stepper motor 41, the exact alignment of the mirrors 26 and 27 with a selected font can be predetermined. Normally such predetermined location is selected by a program within a controller associated with the photocomposer 11, although a hand controlled device may be provided for stepping the motor a given amount under operator control. Such computer controlled devices under program are old and well-known and need not be delineated in detail herein.

The described mechanism will enable to frame 36 to move laterally for selecting a particular font, and as previously described, the width code reading device will follow a single track of the disc, and therefore any one of a plurality of font tracks on a given singular disc may be selected with the apparatus as thus far described.

However, in order to select a data path in another disc 12, the shaft 14 and stanchion 23 must be shifted relative to one another in the direction of shaft axis 14. Longitudinal shifting is provided by mounting the base 35 on a way rod 50 and a drive screw 51 driven by motor 52.

The procedure for selecting is then modified in that the cam 40 is first rotated to a position which causes the perpendicular movement of the shaft 14 to a first limit which separates the largest disc carried by the shaft from the interfitting relationship with the optical system. In the drawings all of the discs 12 are shown of one uniform size, but variable size discs are acceptable if such is desired. A second limit position is one which is preselected to position one of the data tracks of a selected disc into projection relationship with the system 17. First, however, having permitted separation, then the stanchion 23 is moved by driving the screw 51 by means of motor 52 until the selected disc is aligned with the space between the arms of the bifurcated stanchion 23. Then, the cam 40 is caused to rotate until the proper second position limit is reached which is defined as that nominated location which registers a particular track with the optical system.

Accordingly, the object of the invention is carried out by this particular illustrated embodiment wherein a plurality of storage disc members are rotated in unison, but are separable from the projection system in order to shift the projection system and disc relative to one another, preferably by moving the projection system and keeping the disc assembly system longitudinally fixed, and then after selecting an aligning a disc desired with the projection system, the frame of the machine moves perpendicular to the axis of the rotating shaft to engage a new disc and a selected new font track for projection. Such shifting of the optical system is made possible by the provision of the collimated to focused concept of the projection system.

This system is rapid enough to be well within acceptable speed limits of the technology currently available.

What is claimed is:

1. A font storage and optical retrieval system for a photocomposition machine, comprising:

a support frame;

a plurality of indicia storage disc members mounted in superposed relationship, and means for rotating said disc members about a common axis, each said disc having at least one data set in a circular track path;

a projection system mounted on said support frame, means mounting said indicia storage discs for movement of said axis in a path perpendicular to said axis into a first station position a distance from said projection system greater than the diameter of the largest disc and into selected ones of a plurality of relative positions with respect to said projection system wherein said projection system is adjacent a selected data set track path; and means for shifting said projection system in the direction of said axis to place a selected one of said discs into alignment with said projection system;

whereby, said plurality of discs may be removed from interface with said projection system, shifted to align a substitute disc, and repositioned to select various data sets at will.

2. A font storage and optical retrieval system for a photocomposition machine, comprising:

a support frame;

a plurality of indicia storage disc members mounted in superposed relationship about a common axis, each said disc having at least one data set in a circular track path;

means for rotating at least one of said disc members at any one time;

a read head mounted on said support frame, said read head having a fixed longitudinal path of travel;

means for effecting relative separating between said read head and said disc members to position said read head beyond the diameter of the largest disc and for selecting one of a plurality of relative positions wherein said head is adjacent a selected data set track path; and means for effecting relative movement between said storage disc members and said read head along a path in the direction of said axis to place a selected one of said discs into alignment with said read head;

whereby, said plurality of discs and head may be removed from interface with one another, shifted to align into a substitute position, and repositioned to select various data sets at will.

3. In a font storage and optical retrieval system for a photocomposition machine, having a support frame, a plurality set of character storage discs mounted in spaced relationship on a common rotatable shaft, each disc having at least one character font in a circular track, means mounting said shaft on said frame; and means for driving said shaft in rotary movement;

the provision of an illuminating and projecting system which is movable with respect to said disc set for rapid access of a selected disc and font thereon, comprising:

a stanchion longitudinally shiftable relative to said disc set shaft axis;

means for moving said disc set and stanchion relative to one another in a path perpendicular to said shaft axis for separating them during shifting of said stanchion; and an illuminating and projection system having a stationary assembly of light source, collimating lens, and decollimating lens, said collimating and decollimating lenses defining an optical path and being separated at least a distance allowing said stanchion to traverse the full range of disc set;

said illuminating and projecting system having a mobile group carried by said stanchion including a decollimating and focusing lens, a mirror grouping to fold the optical path in an offset loop encompassing a disc track, and a collimating lens to collimate an image produced by said mobile group and return the optical path to said stationary group decollimating lens.

* * * * *